US006186739B1

(12) United States Patent
Hsieh

(10) Patent No.: US 6,186,739 B1
(45) Date of Patent: Feb. 13, 2001

(54) SUPPORT FOR A COOLING FAN

(76) Inventor: Hsin-Mao Hsieh, No. 6, East Section, Chiao Nan Li, Industrial 6th Rd., Pingtung City, Pingtung Hsien (TW)

( * ) Notice: Under 35 U.S.C. 154(b), the term of this patent shall be extended for 0 days.

(21) Appl. No.: 09/392,145

(22) Filed: Sep. 9, 1999

(51) Int. Cl.[7] ..... F01D 25/26
(52) U.S. Cl. ..... 415/213.1; 415/225; 415/224; 416/244 R
(58) Field of Search ..... 415/213.1, 220, 415/224; 416/244 R

(56) References Cited

U.S. PATENT DOCUMENTS 5,251,101 * 10/1993 Liu ..... 248/510
5,288,203 * 2/1994 Thomas ..... 415/213.1

* cited by examiner

*Primary Examiner*—Edward K. Look
*Assistant Examiner*—Hermes Rodriguez
(74) *Attorney, Agent, or Firm*—Bacon & Thomas, PLLC

(57) ABSTRACT

The invention is about an improved support for a cooling fan. The support has a seat for receiving a fan. A plurality of L-shaped arms are securely formed and substantially extend out from the seat, and provided with a first portion parallel to the seat and a second portion rectangular to the seat. A flange is securely formed on the top of the second portions of the arms. The flange is able to conduct air flow and lower the turbulence of air flow in the vicinity of the periphery of the fan so as to enhance the efficiency of the fan. The flange also integrates the supporting plates, so that even only two diagonal supporting plates are fastened by screws to a frame, the rest of the supporting plates are fastened accordingly and can not vibrate any more.

5 Claims, 6 Drawing Sheets

SUPPORT FOR A COOLING FAN

BACKGROUND OF THE INVENTION

1. Field of the Invention

The invention relates to an improved support for a cooling fan, especially to a support abling to enhance the cooling efficiency and lower the noise of the fan.

2. Description of Related Art

Nearly all the present electronic products have cooling fans in the vicinity of the chip or the CPU (Central Processing Unit) to dissipate the heat produced thereof. A typical conventional cooling fan of this kind is shown in FIG. 7. A support (70) has a seat (701) for the mounting of a fan (74) having a plurality of blades (741) substantially extending out therefrom. A plurality of L-shaped arms (71) are securely formed on and substantially radically extend out from the seat (701), with a first portion (711) thereof being parallel to the seat (701) and a second portion (712) thereof being rectangular to the seat (701). A supporting plate (73) is formed at the free end of the second portion (712) of each L-shaped arm (71) and extends substantially parallel to the seat (701). A hole (731) is defined in each supporting plate (73) through which the support (70) is able to be mounted onto a frame (75) by screws. The frame (75) has a none finned area (76) for receiving the support (70) as well the fan (74) and a plurality of fins (77) mounted thereon to increase the area of radiation. Therefore, the support (70) is able to be mounted on the frame (75) by threadingly inserting a screw through the hole (731) and into the gap between two adjacent fins (77).

Although the above mentioned cooling fan is able to dissipate heat generated by the operation of electrical devices, it still has following shortcomings:

1. Causing noise:

When the support (70) is assembled on the frame (75), the manufacturer often, for the purpose of saving materials uses only two screws on the diagonal supporting plates (73). Thus, after operation, small gaps exists between the support (70) and the frame (75), which causes noise.

2. Efficiency reduction:

The theory of heat dissipation used in this conventional fan device is based on the rotation of the blades (741), which draws the surrounding air and then blows the air from the opening between two adjacent L-shaped arms (71). However, during the inward and outward flow of the air, turbulence happens on the distal end portion of the blades (741), which reduces the heat dissipation efficiency.

To overcome the above mentioned drawbacks, it is an objective of the invention to provide an improved support for a cooling fan.

SUMMARY OF THE INVENTION

The main objective of the invention is to provide an improved support for a cooling fan, which has a flange formed on the distal end of each of a plurality of L-shaped arms to conduct and lower the turbulence of air flow so as to enhance the efficiency of the fan.

Another objective of the invention is to provide an improved support for a cooling fan, which has a flange formed on the distal end of each of a plurality of L-shaped arms to integrate the plurality of supporting plates so as to decrease the vibration of the supporting plates thereby decreasing the noises.

Other objects, advantages and novel features of the invention will become more apparent from the following detailed description when taken in conjunction with the accompanying drawings.

DETAILED DESCRIPTION OF PREFERRED EMBODIMENT

Figure 1:
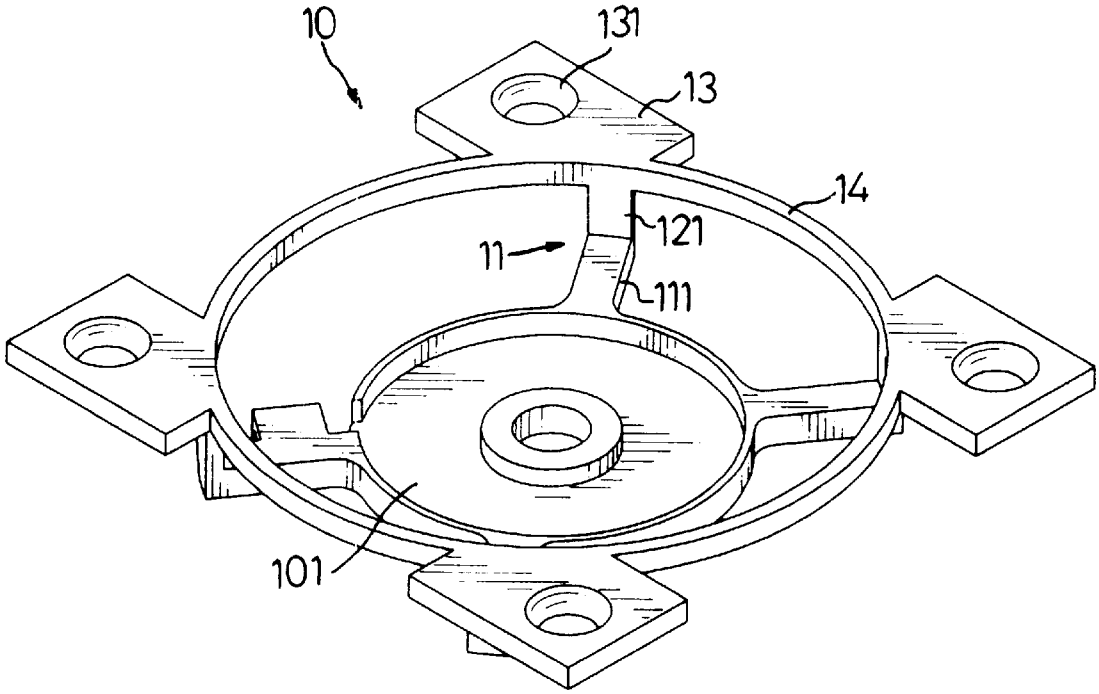
FIG. 1 is a perspective view showing the support constructed in accordance with the present invention.
Figure 2:
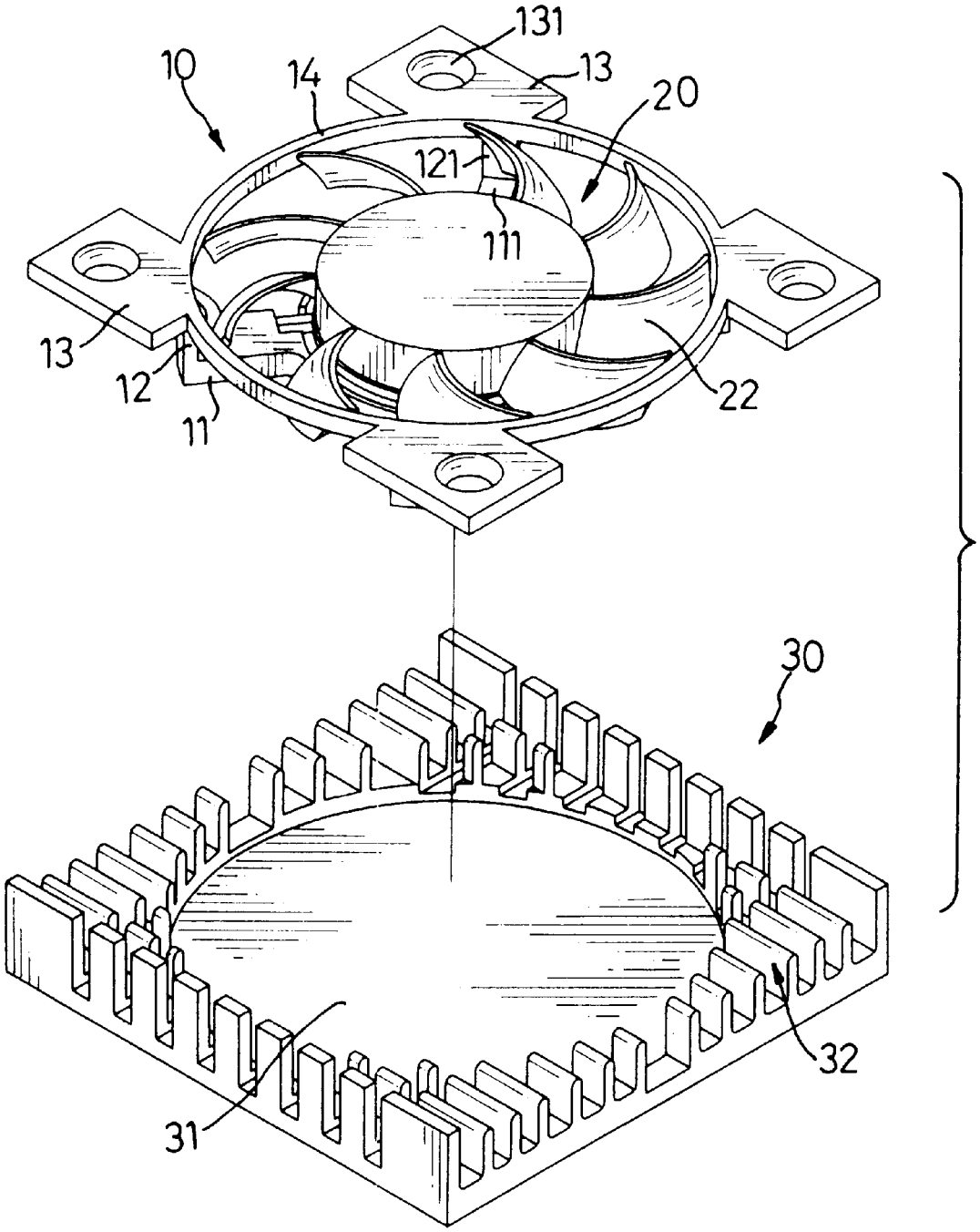
FIG. 2 is a perspective view showing the assembly of a fan and the support of the invention, wherein a frame for receiving the assembly is also shown.
Figure 3:
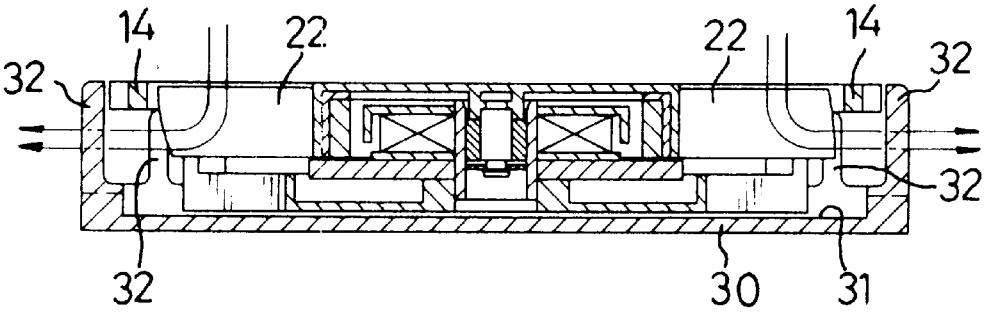
FIG. 3 is a side cross sectional view showing the assembly of the fan and the support that are received in the frame.

With reference to FIGS. 1 and 2, a support (10) constructed in accordance with the present invention is shown. The support (10) has a seat (101) for receiving therein a fan (20) having a plurality of blades (22) substantially extending outward therefrom. A plurality of L-shaped arms (11) are securely formed on and substantially extend out from the seat (101). Each arm (11) has a first portion (111) parallel to the seat (101) and a second portion (112) rectangular to the seat (101). The frame (30) has a central non-finned area (31) for receiving the support (10) as well the fan (20) and a plurality of fins (32) integrally formed thereon to increase the area of radiation.

The difference between the support (10) of the present invention and that of a conventional one is the provision of a flange (14) formed on the free end of each of the second portion (112) of the L-shaped arms (11). A plurality of supporting plates (13) are formed on the outer periphery of the flange (14) and each corresponds to the second portion (112) of the L-shaped arm (11). The supporting plate (13) extends in parallel to the seat (101). A hole (131) is defined in the supporting plate (13), through which the support (10) is able to be mounted onto the frame (30) by screws. In this embodiment, the thickness of the flange (14) is substantially equal to the thickness of each of the supporting plates (13).

Figure 4:
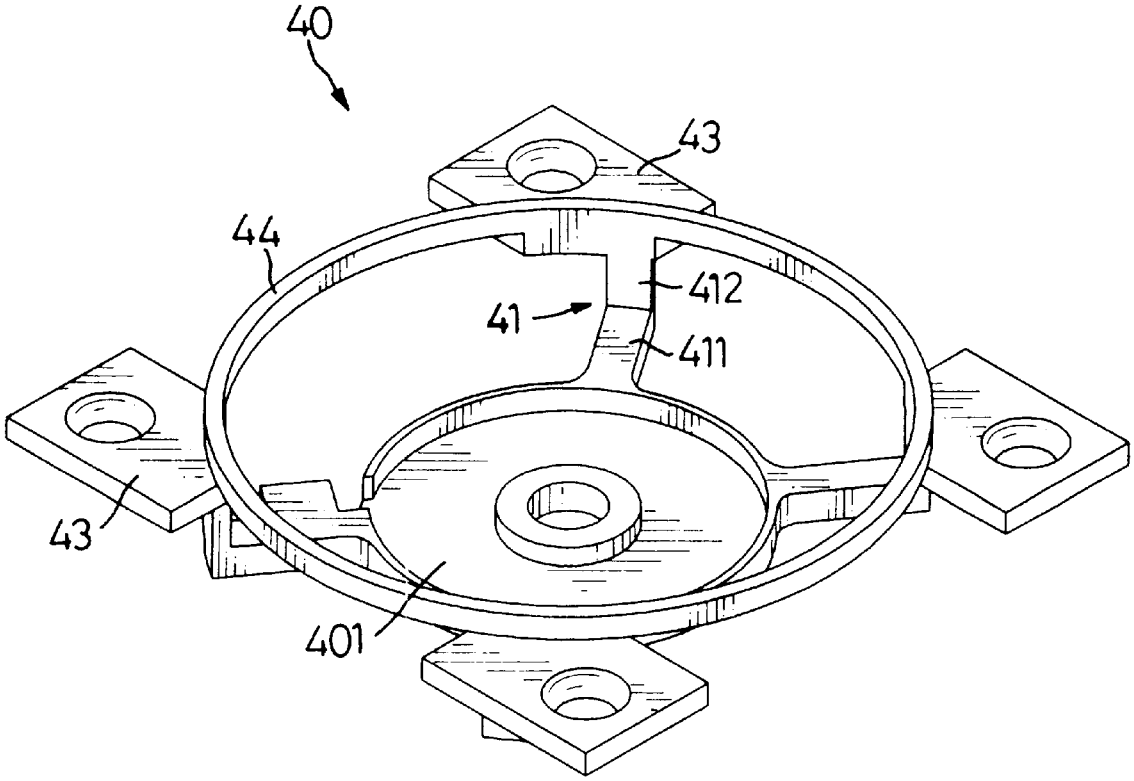
FIG. 4 is a perspective view showing another embodiment of the invention.

With reference to FIG. 4, after the assembly of the support (10) and the fan (20) is received in the frame (30), because of the existence of the flange (14), the air can only be drawn into the support (10) from the top of the support (10) and then propelled outward under the flange (14). The disturbance in the vicinity of the periphery of the blades (22) as described in the related art will no longer appear and therefore the efficiency of the fan (20) for dissipating the heat is increased.

In addition, the supporting plates (13) are integrated by the flange (14), so that even only two diagonal supporting plates (13) are fastened by screws, the rest of the supporting plates (13) are fastened accordingly and can not vibrate any more.

In another embodiment of the invention shown in FIG. 4, a support (40) having a seat (401), a plurality of L-shaped arms (41) divergently extending out therefrom and each having a first portion (411) in parallel to the seat (401) and a second portion (412) rectangular to the seat (401). Furthermore, a plurality of supporting plates (43) are formed under the flange (44) and extend in parallel to the seat (401).

Figure 5:
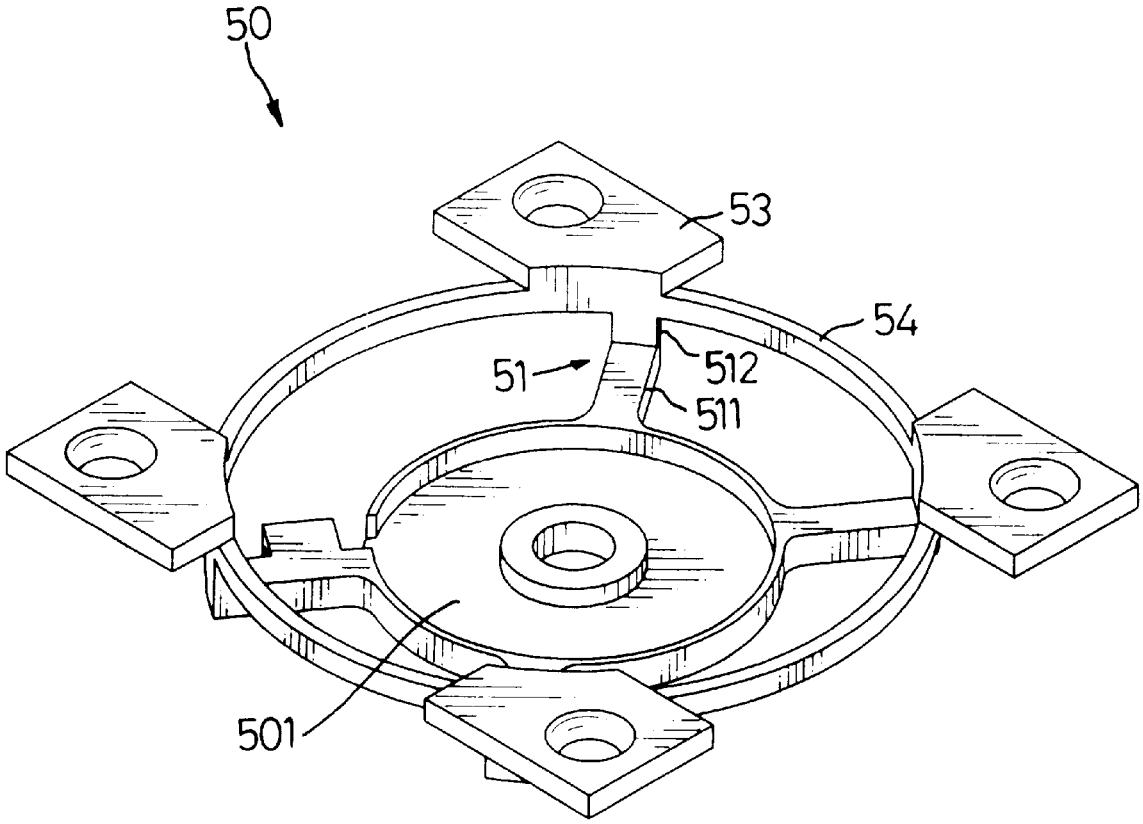
FIG. 5 is a perspective view showing yet another embodiment of the invention.

In yet another embodiment of the invention shown in FIG. 5, a support (50) having a seat (501), a plurality of L-shaped arms (51) divergently extending out therefrom and each having a first portion (511) in parallel to the seat (501) and a second portion (512) rectangular to the seat (501). Furthermore, a plurality of supporting plates (53) are formed on the flange (54) and extend in parallel to the seat (501).

Figure 6:
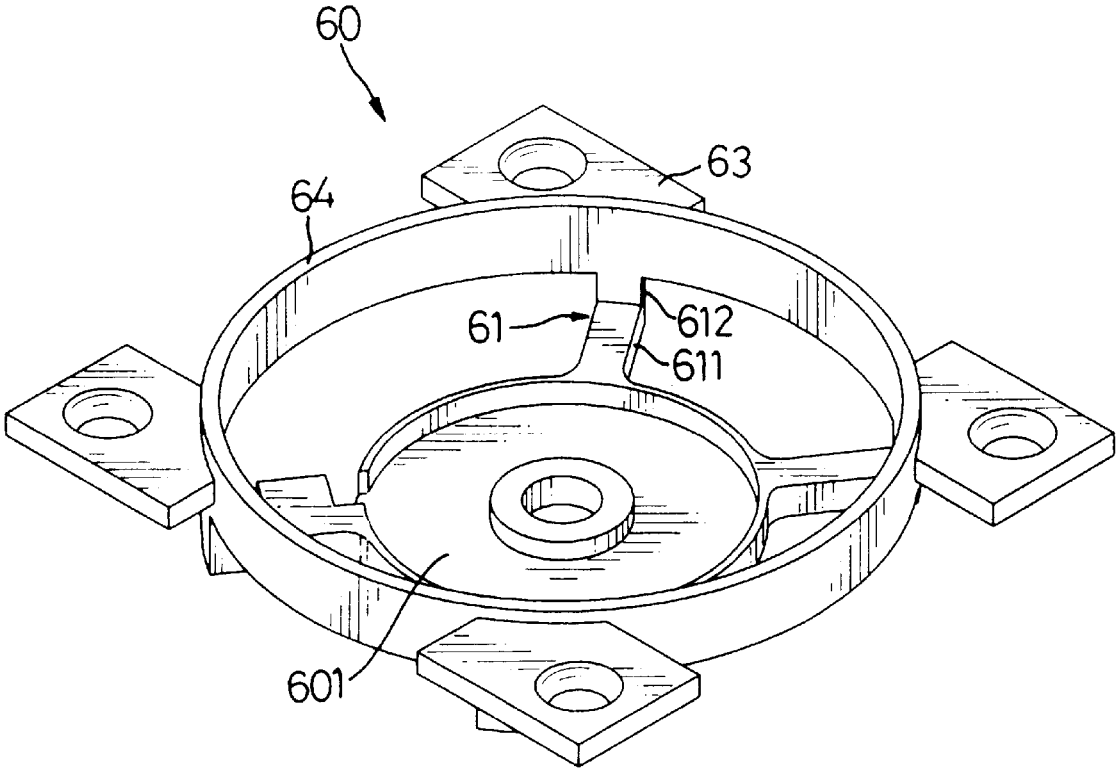
FIG. 6 is a perspective view showing still another embodiment of the invention; and, FIG. 7 is a perspective view showing the assembly of a support and a fan and a frame for receiving the assembly.
Figure 7:
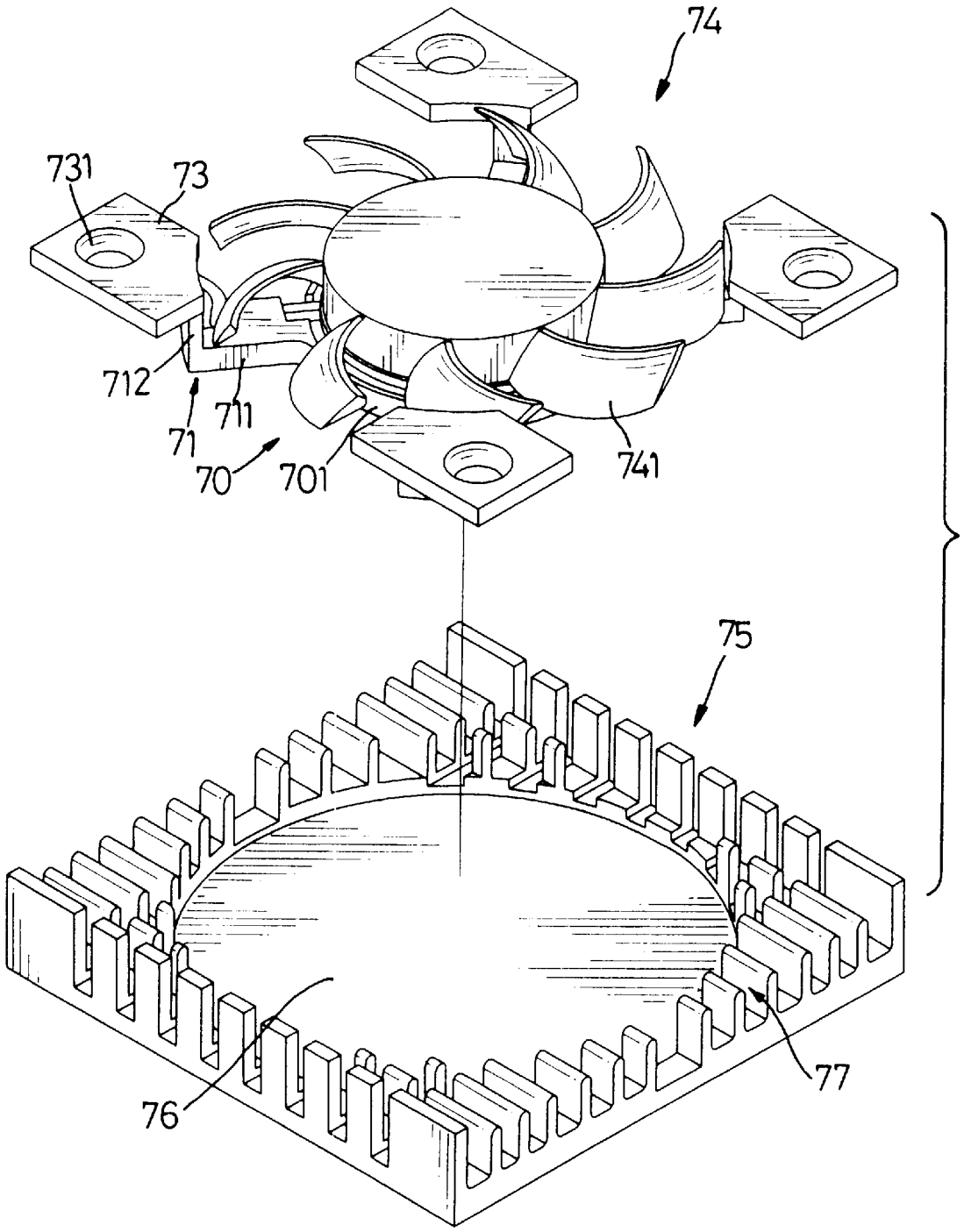
FIG.7 PRIOR ART

In still yet another embodiment of the invention shown in FIG. 6, a support (60) having a seat (601), a plurality of L-shaped arms (61) divergently extending out therefrom and each having a first portion (611) in parallel to the seat (601) and a second portion (612) rectangular to the seat (601). Furthermore, a plurality of supporting plates (63) are formed on the outer periphery of the flange (64) and extend in parallel to the seat (601). The thickness of the flange (64) is larger than that of the supporting plate (63).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A support for a cooling fan, the supporting having a seat (101) for the mounting of the fan, a plurality of L-shaped arms (11) securely formed on and substantially extending out from the seat (101), each having a first portion (111) parallel to the seat (101) and a second portion (112) rectangular to the seat (101), wherein the improvements comprising:

a flange (14) is formed on the free ends of the second portions (112) and has a plurality of supporting plates (13) formed on the outer periphery thereof;

wherein a hole (131) is defined in each of the supporting plates (13) through which the support (10) is able to be mounted onto the frame (30) by screws.

2. The support as claimed in claim 1, wherein the a plurality of supporting plates (13) are formed under the flange (14).

3. The support as claimed in claim 1, wherein the plurality of supporting plates (13) are formed on top of the flange (14).

4. The support as claimed in claim 1, wherein the plurality of supporting plates (13) are formed on the outer periphery of the flange (14); and wherein the thickness of the flange (14) is the same as that of the supporting plate (13).

5. The support as claimed in claim 1, wherein the thickness of the flange (14) is larger than that of the flange (14).

* * * * *